US005774897A

United States Patent [19]

Hochmuth

[11] Patent Number: 5,774,897

[45] Date of Patent: Jul. 7, 1998

[54] GOALKEEPER'S GLOVE WITH IMPROVED FINGERTIP CAPS

[76] Inventor: Peter Hochmuth, Weissenburger Str. 19, D-91757 Treuchtlingen, Germany

[21] Appl. No.: 779,594

[22] Filed: Jan. 7, 1997

[30] Foreign Application Priority Data

Jan. 19, 1996 [DE] Germany ..... 296 00 842.7

[51] Int. Cl.[6] ..... A41D 19/00

[52] U.S. Cl. ..... 2/161.1; 2/159; 2/169

[58] Field of Search ..... 2/161.1, 159, 161.3, 2/161.4, 161.5, 161.6, 161.7, 161.8, 163, 167–169

[56] References Cited

U.S. PATENT DOCUMENTS

| | | | |
|---|---|---|---|
| 141,203 | 7/1873 | Burr | 2/169 |
| 348,806 | 9/1886 | Whitaker | 2/169 |
| 1,377,338 | 5/1921 | Grinnell | 2/169 |
| 4,864,659 | 9/1989 | Morris | 2/161.1 |
| 4,881,276 | 11/1989 | Swan | 2/161.1 |
| 5,136,725 | 8/1992 | Montero | 2/161.1 |
| 5,231,700 | 8/1993 | Cutshall | 2/161.8 |

*Primary Examiner*—Gloria Hale

*Attorney, Agent, or Firm*—Anderson, Kill & Olick, P.C.

[57] ABSTRACT

A goalkeeper's glove, including inner and upper portions having respectively four inner and upper finger regions and inner and upper hand regions, each upper finger region being connected with a respective inner finger region along their lateral edges, with at least one inner finger region having, at a free end thereof, a strip-shaped fingertip extension forming an integral part with the inner finger region, with the finger tip extension being turned over an associated upper finger region, forming a fingertip cap, and the finger tip extension being secured to the associated upper finger region.

5 Claims, 1 Drawing Sheet

11
10
20
16
6
21
19
2
22
14
15
8
3
1
18
17
13
12
5
7
9
4

12
6
15
19
20
8
13
2

GOALKEEPER'S GLOVE WITH IMPROVED FINGERTIP CAPS

BACKGROUND OF THE INVENTION

1. Field of the Invention

The present invention relates to a goalkeeper's glove including un upper portion having four upper finger regions and an upper hand region, and an inner portion having four inner finger regions and an inner hand region, with each upper finger region being connected with a respective inner finger region along lateral edges thereof, and with the upper finger region forming, together with the respective inner finger region, at their common free end, a fingertip cap.

2. Description of the Prior Art

A goalkeeper's glove of the above-described type is disclosed in German publication No. 4,241,261. In the goalkeeper's glove disclosed in this German publication, the free ends of both upper finger regions and inner finger regions lie next to each other, i.e., at the same height, with the free ends being kept together in the fingertip region with transverse seams. The transverse seams are provided at the butt of the two, connected with each other, portions. The closed free ends of two associated upper and inner finger regions form the so-called fingertip caps. When a load is applied to the glove, it acts on the seam or the butt. Such load is applied, e.g, when a goalkeeper leans with the fingertip caps against the ground or tips a ball. As wear marks of an often used goalkeeper's glove show, the fingertip caps of a goalkeeper's glove are subjected to a particularly heavy load. The seams or ridge-shaped stitches associated therewith wear off if the fingertip caps are used often. As a result, a goalkeeper feels an uncomfortable sensation in his fingertips, or the interaction between the glove and the ball is adversely affected.

Accordingly, an object of the present invention is a goalkeeper glove of the above-described type in which the functioning of the caps, provided on the free ends of the finger regions, is not adversely affected by the connecting seams.

SUMMARY OF THE INVENTION

This and other objects of the present invention, which will become apparent hereinafter, are achieved by providing a goalkeeper glove of the above-described type in which at least one inner finger region passes, at its free end, into a strip-shaped fingertip extension, which is formed as one piece with the inner finger region and which is turned over the associated upper finger region and is secured to the upper finger region, forming a fingertip cap.

In the goalkeeper's glove according to the present invention, there is provided, at a free end of the finger region, a cap having no butts at the bottom, at the top, and at the front and the width of which correspond to that of the fingertip extension. The formation of the fingertip extension as one piece with the inner finger region permitted to avoid any seams on the bottom of the inner portion and the transition region, which actually forms the cap. Thus, no seam is provided on the parts which flatly abut each other. The fingertip cap, which is formed by the fingertip extension of the inner finger region, covers a respective fingertip of a goalkeeper, so that there is no contact between a ball and a seam when the goalkeeper touches the ball with his finger. The contact between the fingertips of the goalkeeper and the ball is soft, smooth and non-slippery.

It is particularly preferable and advantageous when all four finger regions are provided with the fingertip extensions. By providing all four finger regions with fingertip extensions, a noticeable improvement of the use characteristics of a goalkeeper's glove is achieved.

In case when a thumb region is also formed of upper and inner thumb regions, it is likewise preferable and particularly advantageous to form the inner thumb region with a fingertip strip-shaped extension, likewise formed as one piece with the inner thumb region, with the thumb fingertip extension being turned over the upper thumb region and being secured thereto. Providing the thumb fingertip cap further improves the use characteristics of the goalkeeper's glove according to the present invention.

It is further preferable and advantageous when the inner portion of the glove has an outer latex layer which also covers the fingertip extension. The latex layer, which seamlessly extend around the fingertip improves the interaction between the glove and a ball, while increasing the grip between the fingertip cap and the ball. When a goalkeeper leans on the fingertips, the latex layer serves as a padding and softens the support, protecting the goalkeeper's fingers against injury.

The formation of the cap does not depend on whether the inner finger regions and the associated upper finger regions are directly stitched along their lateral edges or are connected with a layer strip or side strip which is stitched to both the inner and upper finger regions. The finger regions can be formed as one-piece with respective hand regions.

When both portions of the glove extend on the same side of the seam, a ridge-shaped butt is formed. When one of the two glove portions, which are stitched to each other, is located on one side of the seam and another portion is located on the other side of the seam, a flat stretching of the seam is provided.

It is preferable and especially advantageous when the fingertip extension extends at least over one third of the upper finger region. This prevents the appearance of the butt joints and seams on the top of the fingertip cap, that is, on the upper glove portion, and insures a good abutment of the fingertip extension with the surface of the upper finger region.

It is particularly preferable and advantageous when the turned over region of the fingertip extension covers the entire width of the upper finger region. This prevents the appearance on the top of the fingertip cap of butt joints and seams which further improves the abutment of the fingertip extension with the surface of the upper finger region.

It is further preferable and advantageous when the upper finger region is provided with connecting seams along both lateral edges, with seams extending to the free end and bordering the longitudinal edges of the turned over region of the fingertip extension. This facilitates laying of the fingertip extension over the upper finger region.

BRIEF DESCRIPTION OF THE DRAWINGS

The objects and advantages of the present invention will become more apparent and the invention itself will be best understood from the following detailed description of the Preferred Embodiment, when read with reference to the accompanying drawings, wherein.

DETAILED DESCRIPTION OF THE PREFERRED EMBODIMENT

Figures 1, 2:
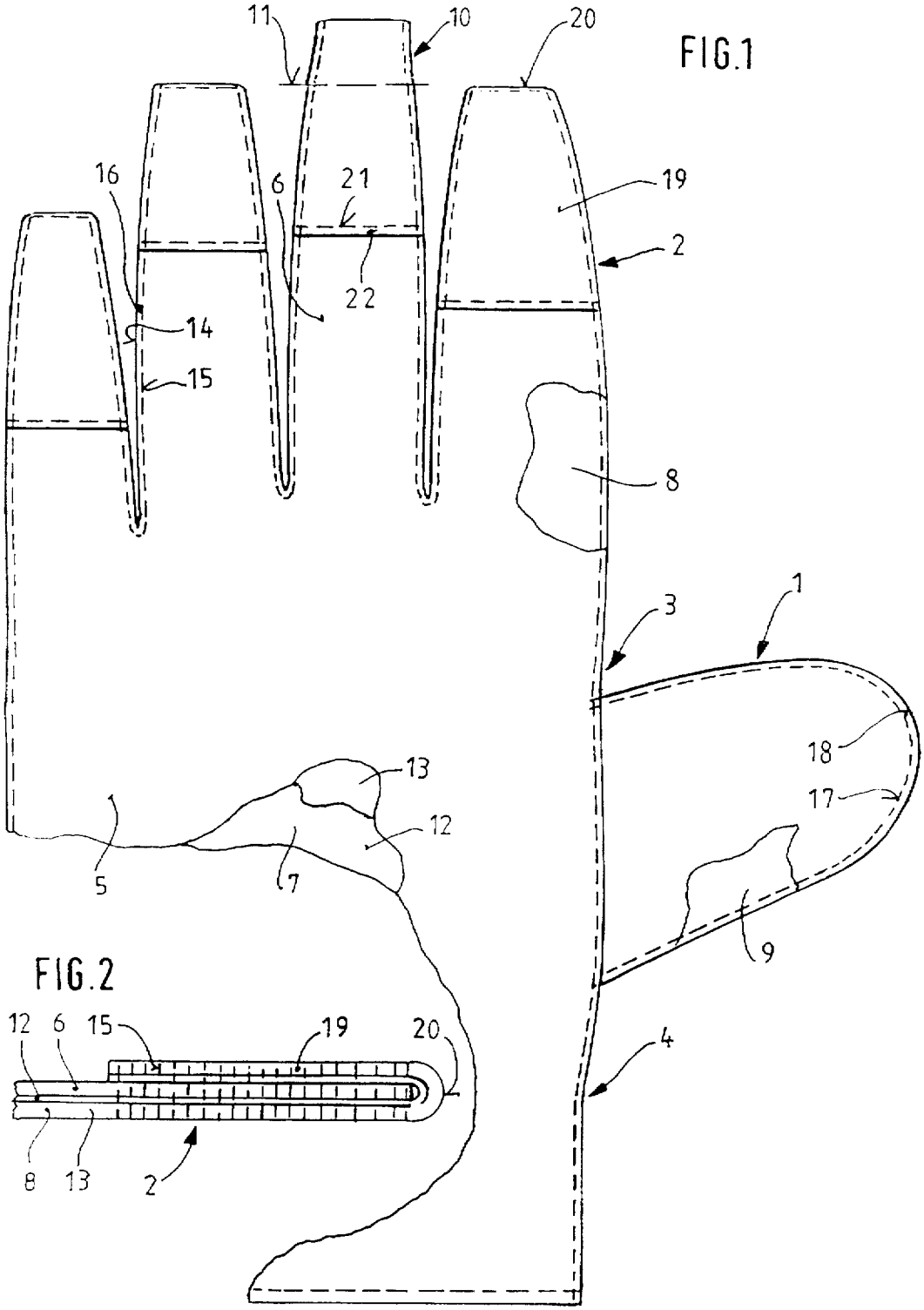
FIG. 1 shows a plan view of a goalkeeper's glove with fingertip caps according to the present invention.
FIG. 2 shows a side view of a portion of a front region of the goalkeeper's glove shown in FIG. 1.

A goalkeeper's glove according to the present invention which is shown in the drawings, has a thumb region 1, four front finger region 2, a hand region 3, and a wrist region 4. An upper wrist region, an upper hand region and four upper finger regions 6 form together a one-piece upper portions of the glove. The inner hand region, four front inner finger regions 8, and an inner finger region 9 of the thumb region 1 form together a one-piece inner portion 7 of the glove. The upper portion 5 is superimposed on the inner portion 7. The tips of the front finger regions 2 and of the thumb region 1 define fingertip caps 10 the ends of which adjacent to the hand region 3 are marked with a dash line 11 (only one line 11 being shown). The inner portion 7 is formed of a carrier layer 12 with a superimposed outer latex layer 13. The four front finger regions 2 and the thumb region 1 are stitched along their respective lateral edges '14 with seams 15 so that ridge-like butts 16 are formed.

At its free end, the thumb region 1 is stitched with a transverse seam 17 so that the fingertip cap defines a transverse stitch 18. Such stitches are not provided in the four front finger regions 2 because these inner finger regions 8 pass each into an extension 19 which is turned upward so that its end 20 forms a tip of the finger region 3. The upwardly turned region of the extension 19 has the same width along its length and which is equal to the width of the upper finger region 6 which the upwardly turned region overlaps. Seams 15 border the upwardly turned region along the lateral edges 14. The transverse edge of the extension 19, which is located adjacent to the hand region 3, is defined on the upper finger region 6 with a seam 21. The upper finger region 6 and the extension 19 form together a flat surface 22.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. A goalkeeper's glove, comprising:

an upper portion having four upper finger regions and an upper hand region; and an inner portion having four inner finger regions and an inner hand region, wherein each upper finger region is connected with a respective inner finger region along lateral edges thereof;

wherein at least one inner finger region has, at a free end thereof, a strip-shaped fingertip extension forming an integral part thereof, wherein the finger tip extension is turned over an associated upper finger region, forming a fingertip cap, the finger tip extension being secured to the associated upper finger region, and wherein the inner portion has an outer latex layer, with the outer latex layer covering the fingertip extension.

2. A goalkeeper's glove according to claim 1, wherein the fingertip extension extends at least over one third of an upper finger region length.

3. A goalkeeper's glove according to claim 1, wherein the fingertip extension extends over an entire width of the upper finger region.

4. A goalkeeper's glove according to claim 3, wherein the upper finger region is provided with connecting seams along both lateral edges thereof, the connecting seams providing for retention of a turned over region of the fingertip extension.

5. A goal keeper's glove, comprising:

an upper portion having four upper finger regions and an upper hand region; and an inner portion having four inner finger regions and an inner hand region, wherein each upper finger region is connected with a respective inner finger region along lateral edges thereof by stitching;

wherein all inner finger regions have at free ends thereof, strip-shaped fingertip extensions forming an integral part thereof, and wherein the finger tip extensions are turned over associated upper finger regions forming respective fingertip caps and are secured to the associated upper finger regions.

* * * * *